US009072365B1

(12) United States Patent
Maneii

(10) Patent No.: US 9,072,365 B1
(45) Date of Patent: Jul. 7, 2015

(54) BACK SUPPORT

(76) Inventor: Fereshteh Maneii, Brookline, MA (US)

( * ) Notice: Subject to any disclaimer, the term of this patent is extended or adjusted under 35 U.S.C. 154(b) by 273 days.

(21) Appl. No.: 13/294,248

(22) Filed: Nov. 11, 2011

(51) Int. Cl.
*A45F 3/02* (2006.01)
*A45F 3/12* (2006.01)

(52) U.S. Cl.
CPC ..... *A45F 3/02* (2013.01); *A45F 2003/127* (2013.01)

(58) Field of Classification Search
CPC ..... A45F 3/00; A45F 3/02; A45F 3/04; A45F 2003/127
USPC ..... 224/153, 155, 262, 642, 644, 652
See application file for complete search history.

(56) References Cited

U.S. PATENT DOCUMENTS 3,185,362 A * 5/1965 Wakefield ..... 224/155
5,228,609 A 7/1993 Gregory
5,529,230 A 6/1996 Smith
5,725,139 A * 3/1998 Smith ..... 224/637
5,819,999 A * 10/1998 Tennant ..... 224/155
5,988,465 A * 11/1999 Vitale et al. ..... 224/155
6,471,105 B1 * 10/2002 Ammerman et al. ..... 224/625
6,491,193 B2 12/2002 Dudek et al.
6,564,387 B1 * 5/2003 Willoughby ..... 2/69
6,637,597 B2 10/2003 Yin
6,681,974 B2 1/2004 Rotter
6,848,746 B2 * 2/2005 Gentry ..... 297/380

* cited by examiner

*Primary Examiner* — Brian D Nash
*Assistant Examiner* — Corey Skurdal
(74) *Attorney, Agent, or Firm* — Steven K Martin; Altman & Martin

(57) ABSTRACT

A back support including a bag, such as a handbag, backpack, or computer bag, a cushion of resilient material shaped to provide lower back support, and a pocket that holds the cushion. The pocket attaches to the bag by a band. A zipper extends across the pocket where the band attaches to the bag and the pocket. The pocket has at least two positions, low and middle, with mid-high and high positions in the current configuration. The pocket is secured in most positions by an attachable/detachable attachment. The attachment is not needed in the low position because the band prevents the pocket dropping lower. The zipper holds the pocket in the middle position. The attachment secures the pocket in the mid-high and high positions. The attachment includes one or more fasteners with one mating fastener component on the pocket and the other component on the outer surface of the bag.

15 Claims, 4 Drawing Sheets

BACK SUPPORT

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to back supports, more particularly, to an adjustable back support that can easily be carried around during the day.

2. Description of the Related Art

It has been estimated that 80% of the U.S. population will suffer from lower back pain at some point in their lives. One of the worse positions for people with back pain is sitting, especially if the back is not being supported. Thus, the 80% number will likely not improve as people spend more time sitting in non-ergonomically correct positions in classrooms, meetings, restaurants, movie theaters, cars, and airplanes, and especially at their computers for work or for social networking, playing games, etc.

There are many products on the market that can be helpful in providing support for people with low back pain. However, it is not always feasible for people to carry their back supports with them to the various places they go throughout the day. As a result they could be sitting for hours during the day with no lower back support, further exacerbating their lower back problem.

BRIEF SUMMARY OF THE INVENTION

The present invention is a back support integrated into a bag that the user can adjust for comfort on seats with different characteristics. The back support includes a bag, a pocket, and a cushion. The bag can be any type of bag including, for example, handbags, backpacks, and computer bags.

The cushion is made from a resilient material and has a contoured shape specifically designed to provide lower back support. The pocket is shaped to fit the cushion. Optionally, the pocket has an opening for removal and insertion of the cushion.

The pocket is attached to the bag by a band that extends the width of the pocket. When the band is fully extended vertically, the bottom edge of the pocket does not fall below bottom of the bag. A zipper extends across the width of the pocket with one zipper component attached to the bag, preferably where the band attaches to the bag, and the other zipper component attached to the pocket, preferably where the band attaches to the pocket. When the zipper is closed, the band drapes downwardly between the bag and pocket.

The height of the pocket is adjustable to at least two positions: low and middle, and the present configuration has four positions: low, middle, mid-high, and high. The pocket is secured in most positions by an attachable/detachable attachment between the bag and the pocket that is composed of one or more fasteners.

In the low position, the band is at its full downward extension. The attachment is not required because the band will not permit the pocket to drop lower. The middle position is where the two band attachments align and the attachment includes the closed zipper. In the mid-high position, the attachment is necessary to secure the pocket in the desired position and includes at least one fastener. In the high position, the attachment is necessary to secure the pocket in the desired position and includes at least one fastener.

The attachment includes one or more fasteners that are located anywhere appropriate, with one mating component of the fastener on the pocket and the other component on the outer surface of the bag. In one configuration, for each fastener, there is one pocket component and one or more bag components depending on the number of pocket positions that need the fastener. In another configuration, for each fastener, there is one bag component and one or more pocket components depending on the number of pocket positions that need the fastener.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention integrates an adjustable back support in a bag so that the user can use it as a back support. The adjustable back support allows the user to adjust the back support for comfort on seats with different characteristics, such as cushion shape and size and inclination angle. Prior to sitting, the user simply puts the bag against the back of the seat, adjusts the back support to the ergonomically-correct height position, and sits.

Figure 1:
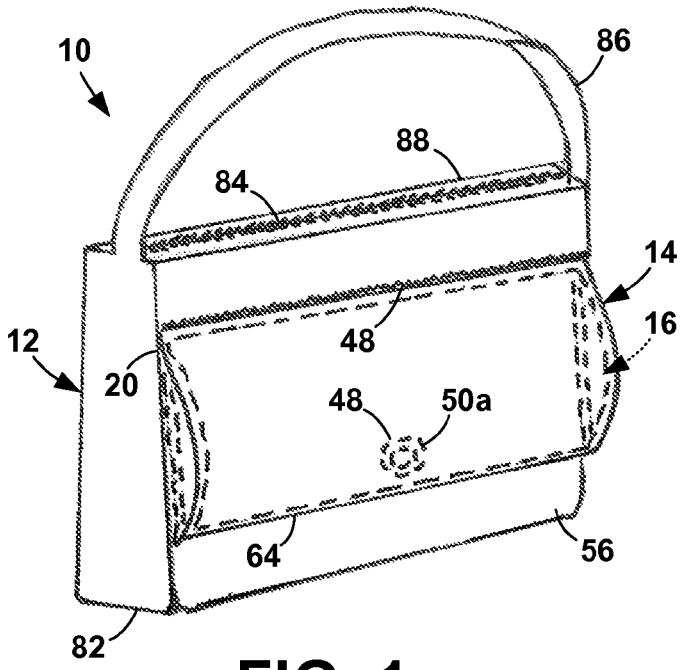
FIG. 1 is a perspective view of the basic back support of the present invention.
Figure 2:
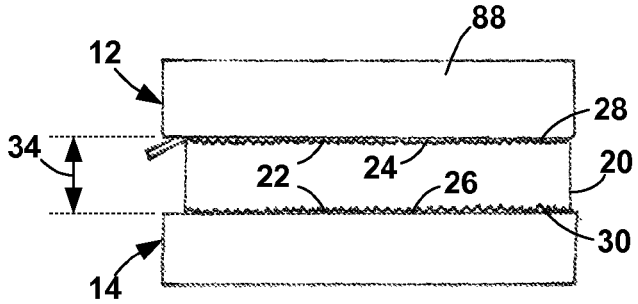
FIG. 2 is a top view of the back support of FIG. 1 showing details of one configuration of the band.

The back support of the present invention, shown in FIGS. 1 and 2, has three main components: (1) a bag 12, (2) a pocket 14, and (3) a cushion 16 (shown in phantom).

The present invention is designed to be used with many types of bags. The sides of the bag 12 can be square or rectangular in shape, the ends can be rectangular or triangular in shape, and the bottom can be rectangular in shape. Optionally, the bag 12 has a zipper 84 at the top 88 which provides access to the interior section. Optionally, the bag 12 has a handle 86 and/or shoulder strap. Examples of bags that can incorporate the present invention include handbags, backpacks, and computer bags. The bag 12 can be composed of leather, neoprene, durable nylon or polyester, or any other material that can accommodate the present invention.

The minimum requirements for a bag 12 for use with the present invention are described below.

The cushion 16 fits into the pocket 14. The cushion 16 is made from a firm viscoelastic polyurethane, polyfoam, or other resilient foam in a contoured shape that is specifically designed to provide lower back support and promote the natural curvature of the spine. The present invention contemplates that the cushion 16 can be different sizes to accommodate different people.

The pocket 14 is shaped to fit the cushion 16. In one configuration, the cushion 16 is sewn into the pocket 14 and is not intended to be removable. In another configuration, shown in FIG. 4, the cushion 16 can be accessed through an opening 90 in the pocket 14. The opening 88 is a slot that extends the length of the pocket 14. Optionally, the opening 90 has a closure 92. The opening 90 permits the removal and replacement of the cushion 16 for cleaning or other reasons.

Figure 3:
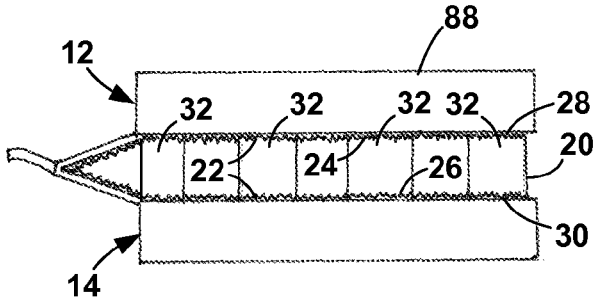
FIG. 3 is a top view of the back support of FIG. 1 showing details of other configurations of the band and zipper.

The pocket 14 is attached to the pocket side 56 of the bag 12 by a band 20 that extends the width of the pocket 14, as in FIG. 2. Alternatively, the band 20 is composed of several strips 32 spaced from each other along the width of the pocket 14, as in FIG. 3. The height 34 of the band 20 and where the band 20 is attached to the pocket side 56 of the bag 12 are such that, when fully extended vertically, the bottom edge 64 of the pocket 14 does not fall below bottom 82 of the bag 12. The band height 34 is at least one-half the vertical distance between the desired lowest position 40 and desired highest position 46, as described below, of the pocket 14. If, for example, that desired distance is three inches, the band height 34 is at least 1½ inches.

A zipper 22 extends over a portion of the width of the pocket 14, and preferably over the entire width of the pocket 14. One zipper component 24 is attached to the pocket side 56 of the bag 12, preferably where the band 20 attaches to the bag 12, as at 28. The other zipper component 26 is attached to the pocket 14, preferably where the band 20 attaches to the pocket 14, as at 30. The zipper 22 can be open-ended as in FIG. 2 where the two components completely separate, or the zipper 22 can be close-ended as in FIG. 3 where one end of each zipper component are permanently attached together. With an open-ended zipper, the zipper 22 can be the width of the pocket 14 or shorter. With the close-ended zipper, the zipper 22 extends beyond the end of the pocket 14 some distance so that the band 20 can fully extend through the entire width of the pocket 14.

Figure 4:
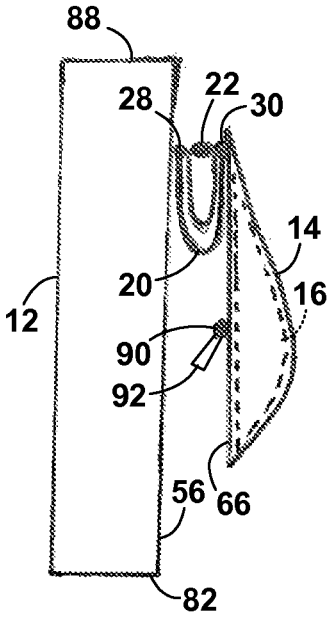
FIG. 4 is an exaggerated side view of a portion of the back support of FIG. 1 showing the folded band.

When the zipper 22 is closed, the band 20 drapes downwardly, folds over itself, and is hidden between the bag 12 and the pocket 14, as in FIG. 4.

The height of the pocket 14 is adjustable to at least two positions: low 40 and middle 42. More positions can be implemented and the present configuration has four positions: low 40, middle 42, mid-high 44, and high 46.

The pocket 14 is secured in most of the positions by an attachable/detachable attachment 48 between the bag 12 and the pocket 14. The attachment 48 is composed of one or more fasteners 50. Examples of different types of fasteners 50 include magnetic fasteners, snaps, hook and loop fasteners, zippers, or any other type of fastener that is attachable/detachable. The present invention contemplates that the attachment 48 can use one or more different types of the fasteners 50 and that each position of the pocket 14 can have its own fastener type.

Figure 5:
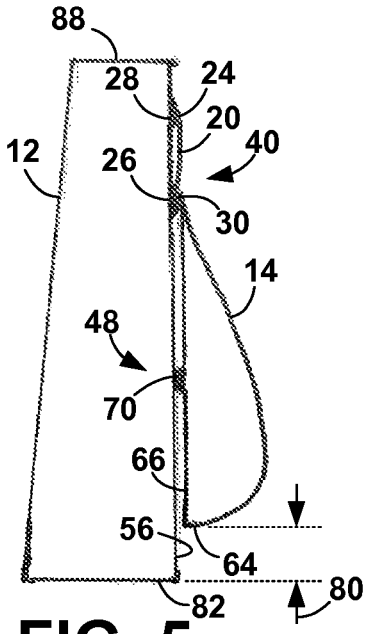
FIG. 5 is a side view of the back support of FIG. 1 in the low position.

In the low position 40, shown in FIG. 5, where the pocket 14 is at its lowest vertical position, the band 20 is typically at its full downward extension. The attachment 48 is not required because, at full extension, the band 20 will not permit the pocket 14 to drop lower. A low fastener 70 may be desired, as in FIG. 5, to secure the pocket 14 in position to keep the pocket 14 from riding up on the bag 12 and out of position during use.

Figure 6:
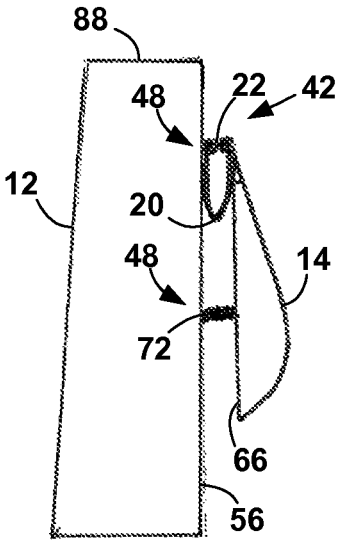
FIG. 6 is an exaggerated side view of the back support of FIG. 1 in the middle position.

The middle position 42 is where the two band attachments 28, 30 align, as in FIG. 6. In the middle position 42, the attachment 48 includes the zipper 22 and is closed. Optionally, a fastener 72 may be used to secure the pocket 14 against the bag 12.

Figure 7:
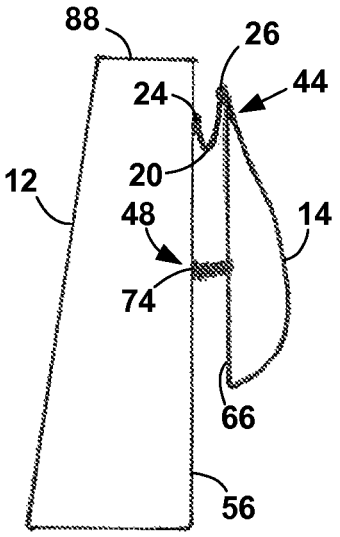
FIG. 7 is an exaggerated side view of the back support of FIG. 1 in the mid-high position.

In the mid-high position 44, shown in FIG. 7, the attachment 48 is necessary to secure the pocket 14 in the desired position and includes at least one fastener 74. The band 20 drapes because it is not fully extended.

Figure 8:
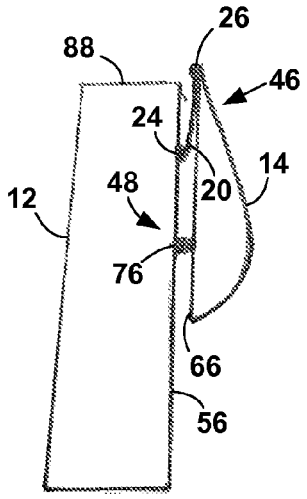
FIG. 8 is an exaggerated side view of the back support of FIG. 1 in the high position.

In the high position 46, shown in FIG. 8, the attachment 48 is necessary to secure the pocket 14 in the desired position and includes at least one fastener 76. Depending on its position relative to the middle position, the band 20 may be fully extended or may drape slightly if it is not fully extended.

In the present configuration, the low position 40 is 1½ inches below the middle position 42 at the full extension of the band 20 with a clearance 80—the distance between the bottom edge 64 of the pocket and the bottom 82 of the bag 12—of about 1½ inches. This gives the band 20 a height of 1½ inches. The mid-high position 44 is ½ inch above the middle position 42. The high position 46 is 1½ inches above the middle position 42.

Figure 9:
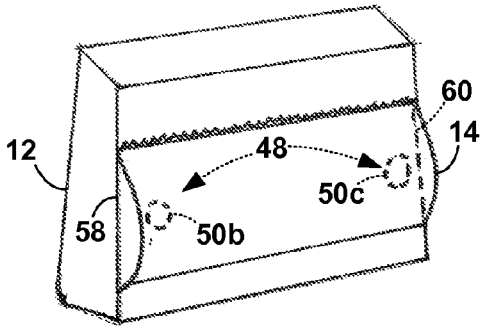
FIG. 9 is a perspective view of the back support of the present invention with different fastener locations.

In FIGS. 5-8, the attachment 48 is shown as single fasteners 70, 72, 74, 76 near the center of the pocket 14. However, the present invention contemplates that the attachment 48 can be one or more fasteners that are located anywhere appropriate. In one example, the attachment 48 is a single fastener 50*a* located on about the vertical center line of the pocket 14, as in FIG. 1. In another example, the attachment 48 includes one fastener 50*b* near one side edge 58 of the pocket 14 and another fastener 50*c* near the other side edge 60 of the pocket 14, as in FIG. 9. In a further example, the attachment 48 includes one fastener 50*d* near the top edge 62 of the pocket 14 and another fastener 50*e* near the bottom edge 64 of the pocket 14, as in FIG. 10. In a further example, the attachment 48 includes one fastener 50*f*, 50*g*, 50*h*, 50*i* at each of the upper and lower corners of the pocket 14, as in FIG. 11.

Figure 12:
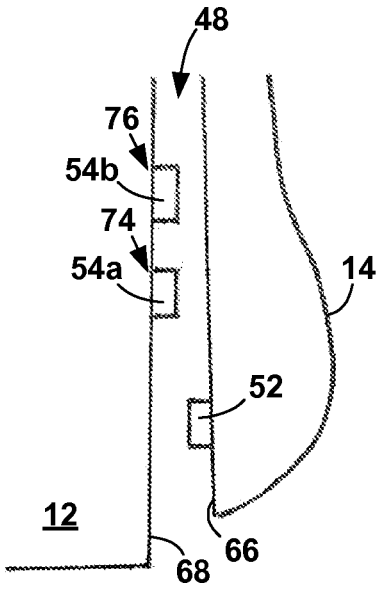
FIG. 12 is an exaggerated detail side view of the back support of the present invention showing one fastener configuration.

Each fastener 50 has two mating components: the pocket component 52 and the bag component 54. The pocket component 52 is located on the rear surface 66 of the pocket 14 and the bag component 54 is located on the outer surface 68 of the pocket side 56 of the bag 12. In one configuration, for each fastener 50, there is one pocket component 52 and one or more bag components 54. The number of bag components 54 depends on the number of pocket positions that need the fastener 50. For example, with the four-position configuration, the low 40 and middle 42 positions do not need a fastener, so there are two bag components for the fastener 50, one bag component 54*a* for the mid-high position fastener 74 and one bag component 54*b* for the high position fastener 76, as in FIG. 12.

Figure 13:
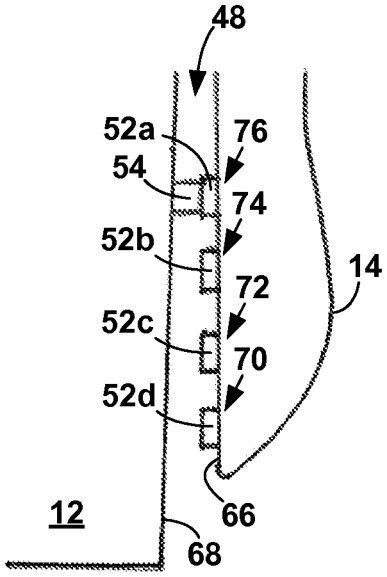
FIG. 13 is an exaggerated detail side view of the back support of the present invention showing another fastener configuration.

In another configuration, for each fastener 50, there is one bag component 54 and one or more pocket components 52. The number of pocket components 52 depends on the number of pocket positions that need the fastener 50. For example, with the four-position configuration and the optional fastener in the low 40 and middle 42 positions, there is one bag component 54 and four pocket components 52*a*, 52*b*, 52*c*, 52*d* for the fastener 50, one each for the low, middle, mid-high, and high positions, as in FIG. 13.

Because of the minimum size of the cushion 16 needed to provide adequate back support, the minimum dimensions for the pocket 14 are 6 inches high, 8 inches wide, and 2 inches deep.

In order to work with the present invention, the bag 12 should to meet certain minimum size requirements.

The minimum height of the bag 12, that is, the minimum height of the pocket side 56 of the bag 12, depends on several factors: (1) the height of the pocket 14, (2) the distance between the low position 40 and the high position 46, (3) the desired clearance 80 from the bottom edge 64 of the pocket 14 to the bottom 82 of the bag 12 in the low position 40, and (4) where the fasteners 50 are located.

Figure 10:
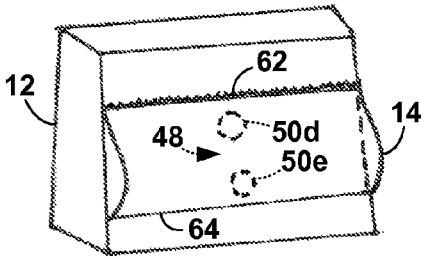
FIG. 10 is a perspective view of the back support of the present invention with different fastener locations.
Figure 11:
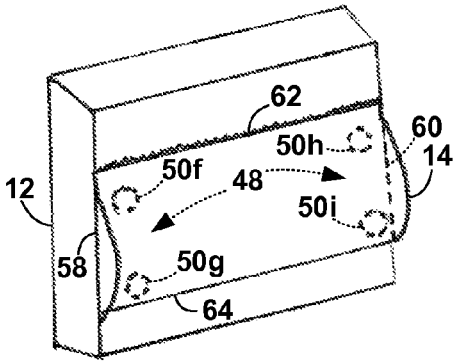
FIG. 11 is a perspective view of the back support of the present invention with different fastener locations.
Figure 14:
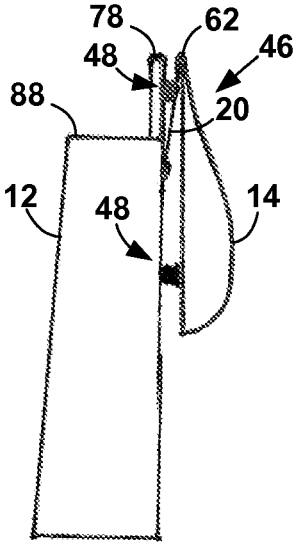
FIG. 14 is a side view showing an extension panel.

In one scenario, where the pocket 14 is 6 inches high, the distance between the low position 40 and the high position 46 is 3 inches, the clearance 80 is 1½ inches, and the fasteners 50 are in the configuration of FIG. 10, with a fastener 50*d* near the top edge 62 of the pocket 14, the minimum height of the pocket side 56 of the bag 12 is about 10½ inches. In such a scenario, if the pocket side 56 of the bag 12 is not the needed minimum height, an extension panel 78 can be attached to extend upwardly from the pocket side 56 of the bag 12, as in FIG. 14.

As to width, the pocket side 56 of the bag 12 is preferably at least the width of the pocket 14. This means that, in the present implementation, the bag 12 is at least 8 inches wide.

The present invention does not contemplate a minimum thickness for the bag since the thickness is not related to the back support or how it works. However, in order to be useful, the bag should be at least 2 inches thick.

The pocket side 56 of the bag 12 needs to be relatively rigid. If the pocket side 56 of the bag 12 was not relatively rigid, the pocket 14 would likely sag downwardly during use, thereby changing the position of the cushion 16 relative to the user's back and rendering the back support less functional.

The present invention contemplates that the pocket side 56 can be made relatively rigid in several different ways. The pocket side 56 can be composed of a sheet of relatively rigid material. Optionally, the sheet of relatively rigid material is covered by an outer layer of cloth, leather, or other flexible, more stylish material. Alternatively, the pocket side 56 of the bag 12 is a layer of flexible material over a relatively rigid frame. In the present invention, a relatively rigid pocket side 56 is one that is rigid enough to prevent significant sagging of the pocket 14 during use. Optionally, the rear surface 66 of the pocket 14 is also relatively rigid.

Thus it has been shown and described a back support.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A back support comprising:

(a) bag having a relatively rigid side with an outer surface;

(b) a pocket having a rear surface and an upper edge;

(c) a cushion specifically shaped to provide back support within said pocket;

(d) a band undetachably connecting said outer surface at a bag band attachment to said pocket at a pocket band attachment;

(e) a zipper for removably attaching said bag to said pocket, said zipper attached to said bag at said bag band attachment and to said pocket at said pocket band attachment;

(f) said pocket having at least two positions relative to said outer surface, a low position wherein said zipper is unfastened and said band is fully extended downwardly and a middle position wherein said zipper is fastened and said band is draped between said bag and said pocket.

2. The back support of claim 1 further comprising a high position wherein said zipper is unfastened and said band extends upwardly from said bag band attachment, and a high attachable/detachable attachment for maintaining said pocket in said high position.

3. The back support of claim 2 wherein said high attachment includes at least one attachable/detachable fastener.

4. The back support of claim 2 further comprising an extension panel extending upwardly from said relatively rigid side for said high attachable/detachable attachment.

5. The back support of claim 2 further comprising a mid-high position between said middle position and said high position, and a mid-high attachable/detachable attachment for maintaining said pocket in said mid-high position.

6. The back support of claim 5 wherein said mid-high attachment includes at least one attachable/detachable fastener.

7. The back support of claim 1 wherein said band is attached to said pocket at said pocket upper edge.

8. The back support of claim 1 further comprising a low attachment for maintaining said pocket in said low position.

9. The back support of claim 1 wherein said cushion is removable.

10. A back support comprising:

(a) bag having a relatively rigid side with an outer surface;

(b) a pocket having a rear surface and an upper edge;

(c) a cushion specifically shaped to provide back support within said pocket;

(d) a band undetachably connecting said outer surface at a bag band attachment to said pocket at a pocket band attachment on said upper edge of said pocket;

(e) a zipper for removably attaching said bag to said pocket, said zipper attached to said bag at said bag band attachment and to said pocket at said pocket band attachment;

(f) said pocket having at least three positions relative to said outer surface, a low position wherein said zipper is unfastened and said band is fully extended downwardly, a middle position wherein said zipper is fastened and said band is draped between said bag and said pocket, and a high position wherein said zipper is unfastened and said band extends upwardly from said bag band attachment; and (g) a high attachable/detachable attachment for maintaining said pocket in said high position, said high attachment including at least one attachable/detachable fastener.

11. The back support of claim 10 further comprising an extension panel extending upwardly from said relatively rigid side for said attachable/detachable fastener.

12. The back support of claim 10 further comprising a mid-high position between said middle position and said high position, and a mid-high attachable/detachable attachment for maintaining said pocket in said mid-high position.

13. The back support of claim 12 wherein said mid-high attachment includes at least one attachable/detachable fastener.

14. The back support of claim 10 further comprising a low attachment for maintaining said pocket in said low position.

15. The back support of claim 10 wherein said cushion is removable.

* * * * *